United States Patent [19]

Barber et al.

[11] 4,281,445

[45] Aug. 4, 1981

[54] APPARATUS AND METHOD FOR REPLACEMENT OF FILE FOLDERS HAVING FASTENERS

[75] Inventors: Donald T. Barber, Toronto, Canada; George B. Pfeffer, Minnetonka; Esther E. Olson, Cottage Grove, both of Minn.

[73] Assignee: Datafile Limited, Willowdale, Canada

[21] Appl. No.: 53,561

[22] Filed: Jul. 5, 1979

[51] Int. Cl.[3] ..... B42F 3/02; B25C 11/00

[52] U.S. Cl. ..... 29/426.5; 29/239; 402/19; 402/80 R; 11/1 AC; 254/28

[58] Field of Search ..... 227/63; 254/28; 11/1 A, 11/1 AC, 1 MB; 29/426.5, 426.6, 402.08, 402.03, 237.5, 239, 796, 814; 402/19, 80 R

[56] References Cited

U.S. PATENT DOCUMENTS

| | | | |
|---|---|---|---|
| 796,346 | 8/1905 | McBee | 11/1 MB |
| 2,945,246 | 7/1960 | Duncan et al. | 11/1 AC |
| 3,879,783 | 4/1975 | Giulie | 11/1 MB |
| 3,967,336 | 7/1976 | Cutter | 11/1 AC |

*Primary Examiner*—Milton S. Mehr

[57] ABSTRACT

Process and apparatus is disclosed for replacing file folders, such as required in the conversion of a filing system. Apparatus comprises a support for supporting fastened file material next its fastener during and after fastener withdrawal and fastener remover for withdrawing fastener and file folder away from supported file material. The supported material may be clamped to facilitate replacement of new file folders with corresponding fasteners. The process comprises the steps of inserting a support between file material and file folder fastened thereto by a fastener to position the support next to the fastener, clamping the fastened file material, stripping the file folder with fastener away from the supported clamped material, replacing file folder with new folder and fastener, releasing the clamped material and closing the fastener to secure the file material in the replacement folder.

33 Claims, 9 Drawing Figures

FIG.1.
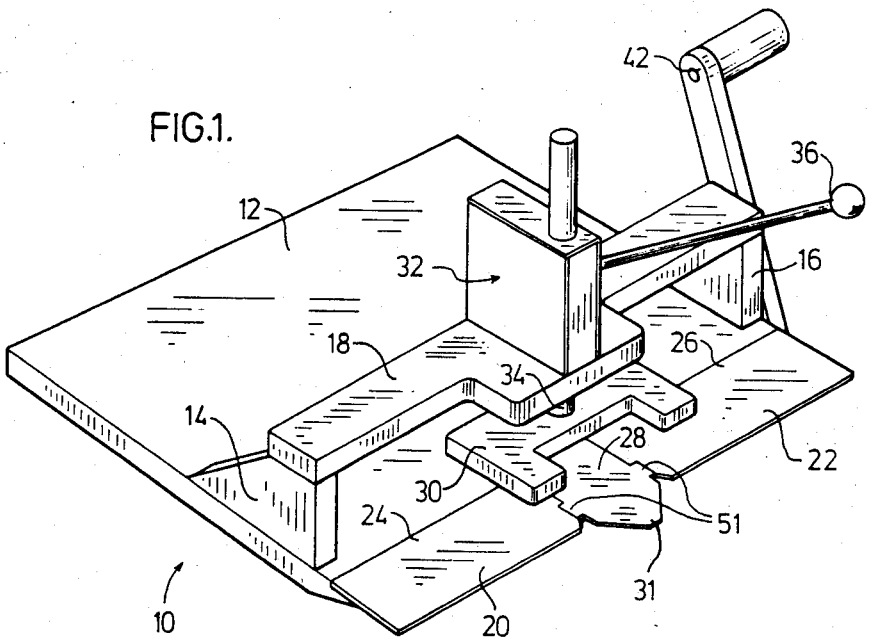
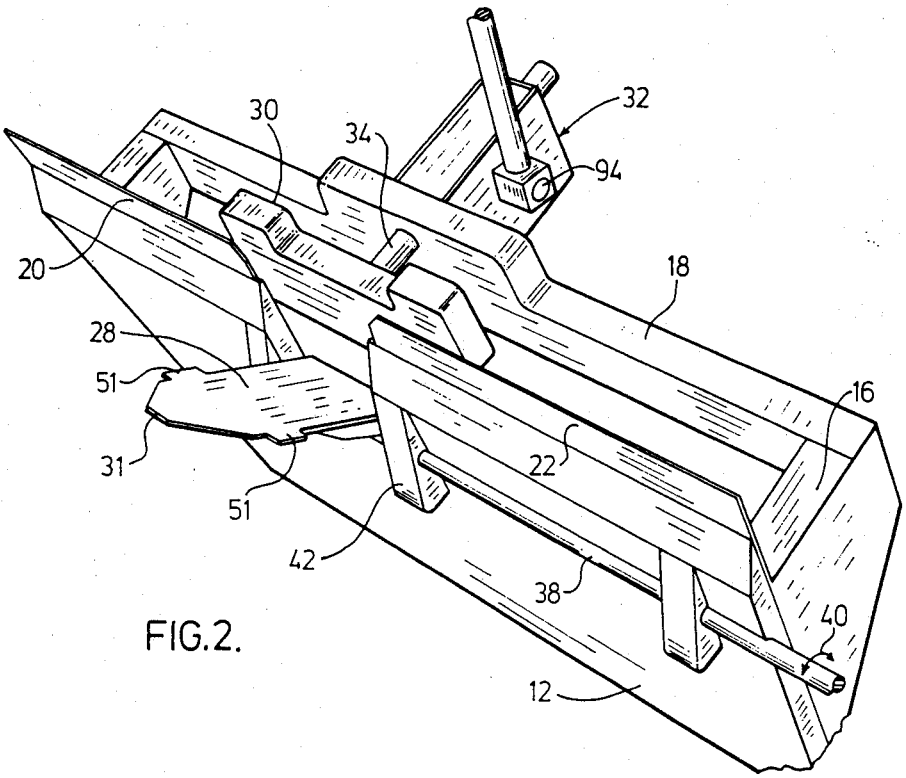
FIG.2.

FIG.3.
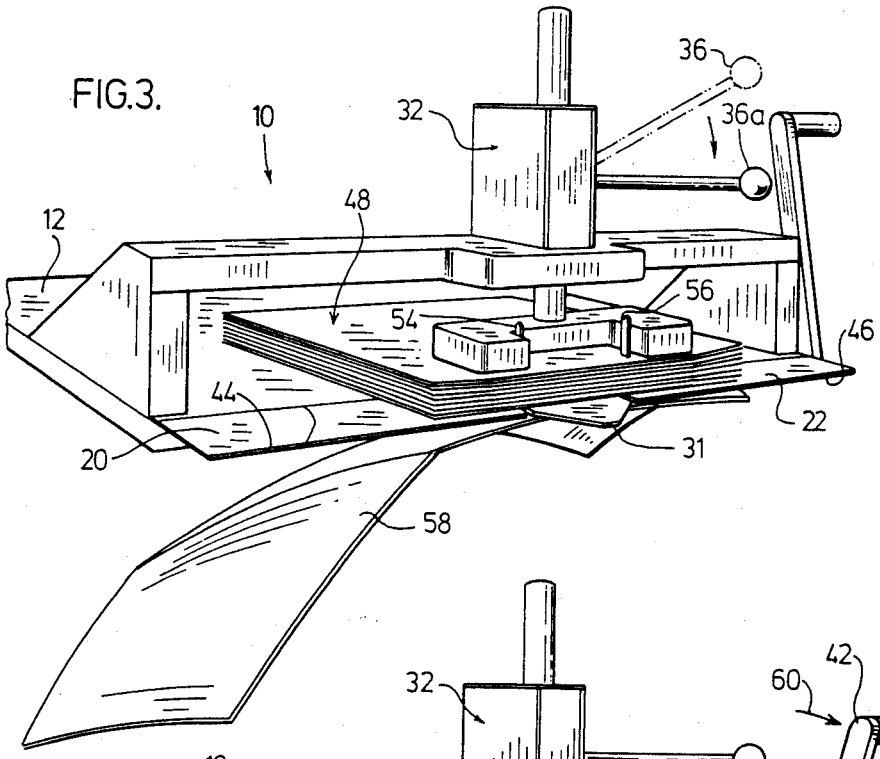
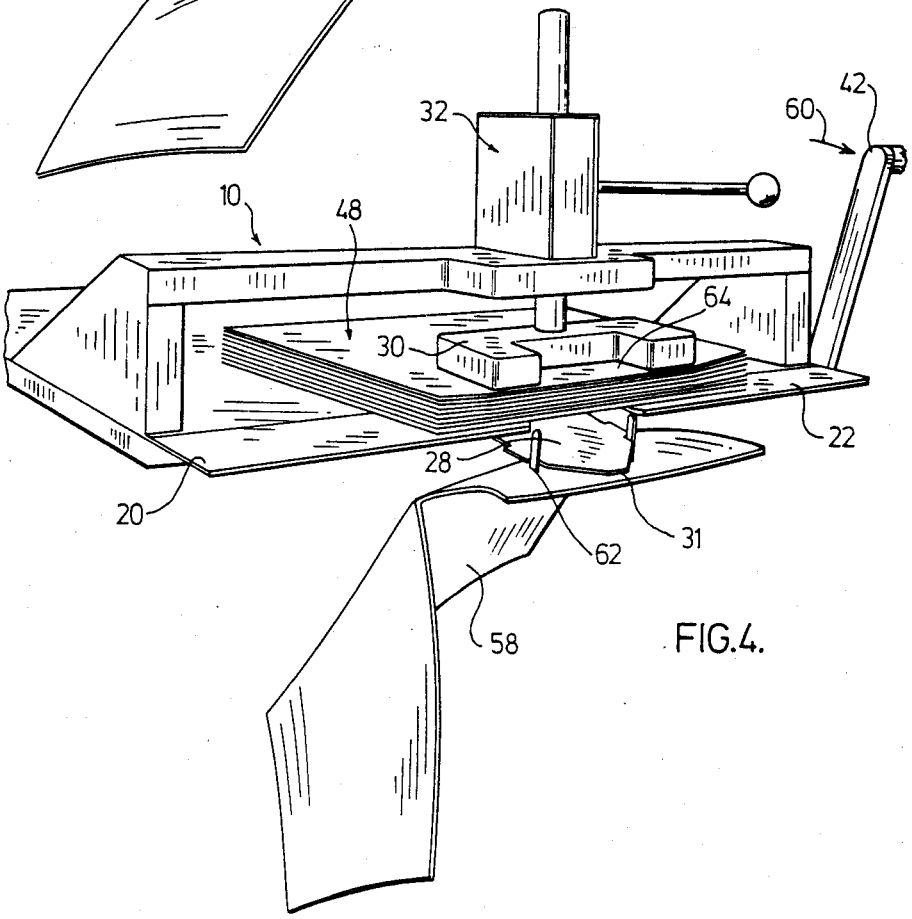
FIG.4.

APPARATUS AND METHOD FOR REPLACEMENT OF FILE FOLDERS HAVING FASTENERS

FIELD OF THE INVENTION

This invention relates to process and apparatus for removing fastener from fastened paper sheets and more particularly to the replacement of file cover fastened to file paper by a fastener.

BACKGROUND OF THE INVENTION

For several reasons, it has become necessary in the operation of a filing system to replace the file back, or file folder with file material fastened thereto, of several files in the system. This change of file folder has been commonly referred to as "pin-to-pin" conversion whenever file folders have a fastener involving one or two prongs for fastening file cover to file material. In the past the standard approach in replacing such a file cover is to manually remove the material from the old folder in a step-by-step operation. For example, with a file folder having a two prong fastener with half an inch of file material attached, first the prongs are straightened and about a quarter of an inch of file material is pulled off the prongs and turned over face down. Next another quarter of an inch of file material is removed and placed face down on top of the file material just removed. The operation is repeated until all the file material has been removed from the folder. The next step of operation is the placing of the file material thus removed onto the prongs of a new folder. Here a quarter of an inch of file material is carefully picked off the pile of loose file material, being careful if possible to keep the holes in line so that it can be threaded on the prongs of the new folder. The operation is repeated until all the file material has been placed on the new folder. If the file material in a folder is an inch thick, the operation is just that much more tedious and time-consuming.

This manual approach has several drawbacks. In addition to the time-consuming effort, there is a substantial likelihood of improper transfer of papers, loss of papers and mixing up of papers. There is also the frustrating aspect in this manual "pin-to-pin" conversion that the holes in the removed file material do not always align with the new fastener prongs because the paper is free to move out of alignment during the transfer. Thus, small portions of a large file, as can be gripped by both hands, can only be transferred at one time, thereby increasing the time needed to convert a filing system. As can be appreciated, in instances where a complete filing system is to be converted, this is a very labour intensive project and in most instances has dissuaded concerns from converting their filing system.

The apparent reasons for replacing a file folder are in instances when a file folder has worn out and it is desirable to replace it, or to break the file contents down into smaller sub-groups to be placed in one or more new file folders. Another reason for replacing file folders, and which usually involves converting a complete filing system, is converting to colour coding systems, such as that disclosed in co-pending U.S. patent application Ser. No. 775,687. That type of colour coding system includes machine readable indicia on the labels to enable the computerized control of file charge-out. This system is becoming very attractive and, in view of the machines now capable of labelling such file folders in rapid succession, as disclosed in U.S. patent application Ser. No. 830,118, there is a much greater demand for file system conversion. However, the above-mentioned drawbacks of manually converting a file system have prevented the adoption of such new colour coded systems and many companies are compelled to continue with their original filing systems, as inefficient and unproductive as they might be.

It is, therefore, an object of the invention to provide process and apparatus for removing a fastener from fastened file material in a manner which permits easy replacement of fastener with file back or file folder. This provision makes the conversion of large filing systems far more attractive.

SUMMARY OF THE INVENTION

In removing fasteners from fastened bulk paper sheets, the apparatus, according to the invention, comprises means for supporting fastened bulk paper sheets, next the fastener during and after fastener withdrawal and means for withdrawing releasable fastener away from such supported side of bulk paper sheets. This apparatus, as applied to replacing file folders, positions the support means between file material and the file cover. Means is provided for holding fastened material in position during and after removal of the file fastener. The means for holding the fastened material is releasable after replacement of another file folder with fastener.

The process, according to this invention, for file folder conversion comprises inserting a support between file material and file folder fastened thereto by a fastener to position the support next to the fastener. Fastened file material is clamped against the support and then file folder with fastener stripped away from the supported clamped material. A replacement file folder, with fastener, is placed onto the clamped file material. The clamped material is released, and fastener closed to secure the file material in the file folder.

BRIEF DESCRIPTION OF THE DRAWINGS

Preferred embodiments of the invention are shown in the drawings wherein:

FIG. 1 is an isometric view of a preferred embodiment of the apparatus for replacing file folders;

FIG. 2 is an isometric view from the bottom of the apparatus of FIG. 1;

FIG. 3 shows the apparatus of FIG. 1 with file folder and material in position with file folder to be replaced;

FIG. 4 shows the arrangement of FIG. 3 wherein old file folder has been stripped from clamped file material;

DETAILED DESCRIPTION OF THE PREFERRED EMBODIMENTS

Figure 5:
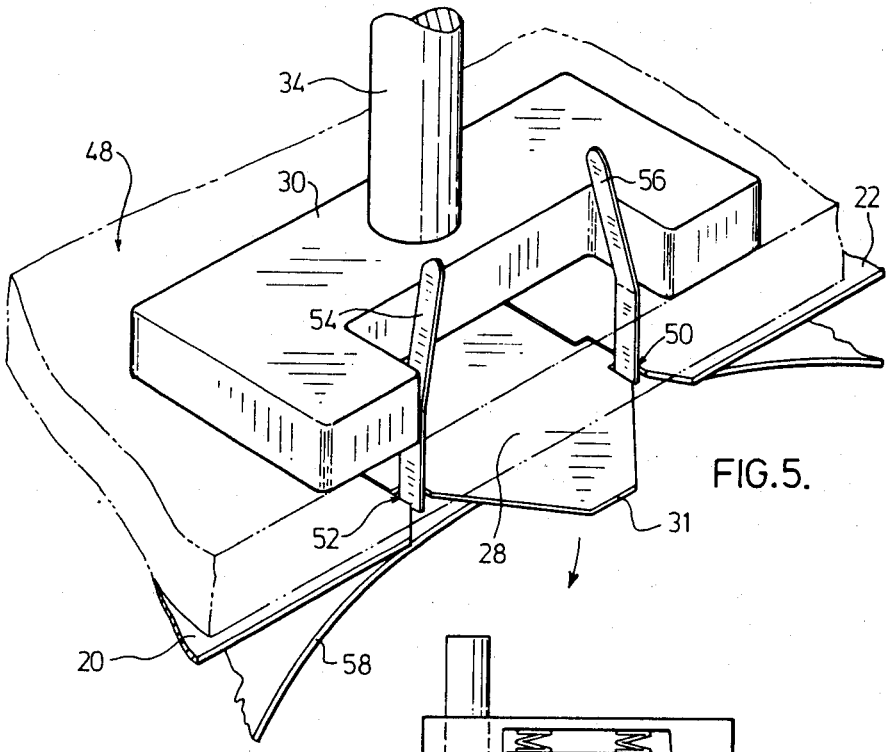
FIG. 5 is a detail showing the relationship of support for file material, clamp therefor and component for removing file folder and fastener away from clamped material.

Referring to FIG. 1, the apparatus 10 for replacing file folders by withdrawing fastener from fastened material is shown. The apparatus 10 comprises a machine frame having base plate 12, standards 14, 16 and supporting overhead member 18. Located forwardly of the base plate 12, is the support means for insertion between file folder material and file folder to support such material next to its fastener. In this embodiment, the support means is in the form of a pair of plates 20 and 22 which are secured at their base portions 24 and 26 to the base plate 12. The arrangement provided by the pair of plates is, therefore, equivalent to a single plate having a recessed portion in its free end, so as to accommodate, in this instance, the width of the two prong fastener.

The component of the apparatus 10 for removing fastener from fastened material is in the form of a tongue or blade 28 having a tapered forward portion 31 which is positioned between the spaced-apart plates 20 and 22. The tongue 28, with its forward portion 31, is inserted between the fastened file material and file cover and positioned to overlie base of a fastener to remove same from the fastened material in the manner to be discussed.

Located above and spaced-apart from the support plates 20, 22 is a clamp pad 30 connected to a drive 32 for driving the rod 34, secured to the clamp pad. Such clamping device is used to hold file material in position during the removal of the fastener therefrom and thereafter, to facilitate insertion of new fastener with file folder. The drive means 32 has a lever 36 which is used to move the clamp pad into and out of clamping position with respect to the file material.

Referring to FIG. 2, the fastener remover 28 has been pivoted downwardly away from the support means in the form of plates 20 and 22 by rotation of the axle 38 in the counterclockwise rotation, the movement being indicated by arrows 40. In order to manually operate the movement of the fastener remover 28, a crank arm 42, as shown in FIG. 1, is secured to the axle 38. The axle 38 may be supported on the underside of the base plate 12 by recessed lug members 42.

With the particular embodiment shown and described with respect to FIGS. 1 and 2, the device is adapted to remove the standard two prong fastener from fastened material. Such two prong fasteners are commonly sold under the ACCO trademark and are well known in the field of filing systems. Such fasteners may be connected to a file folder by securing with hot-melt adhesive a strip of fibre reinforced paper overlying the base of a two prong fastener. The fastener may also be secured to the folder by providing tabs on the base of the two prong fastener which are crimped onto the folder to hold the fastener in position. A further approach which is somewhat simpler is to provide a pair of holes in the folder through which the fastener prongs extend as the base of the fastener rests against the face of the folder.

A file with material clipped therein is placed on the apparatus, as shown in FIG. 3. For sake of illustration, the apparatus 10 is disposed horizontally; however, it is appreciated that, to facilitate loading of the file onto the apparatus, the base plate 12 with support plates 20 and 22 may be inclined at an angle of approximately 75°. The leading edges 44 and 46 of the support plates are sufficiently thin to permit insertion thereof between the clipped file material 48. The opposing edges, as shown in more detail in FIG. 5, of support plates 20 and 22 have notched portions as indicated at 50 and 52 to receive the prongs 54, 56 of the standard two prong fastener. Thus, the support plates 20 and 22 provide support for the bulk fastened material 48 in the area next to and to each side of fastener prongs 54, 56.

The tapered forward portion 31 of the tongue 28 facilitates positioning thereof between the prongs 54, 56 of the fastener in the manner shown in FIG. 5. The tongue portion 28 overlies the base portion (not shown) of the fastener, which in this instance is spaced therefrom by the thickness of the file folder 58. Thus, the tapered portion 31, as it engages the prongs, guides the insertion of the tongue 28 into a proper position. As shown in FIG. 3, the folder 58 is separate and apart from the bulk material 48, because base plate 12 and adjoining plates 20 and 22 are interposed. Prior to removal of the folder with fastener, the lever 36 of the drive 32 is lowered to position **36*a* to clamp the bulk form material 38 in position. The fastener prongs 54, 56 may be removed from a prong holder having the movable sleeves and bent upwardly to the position shown in FIG. 3, prior to removal of fastener from the fastened material. However, it is understood that, with the mechanical advantage of the crank arm 42, the fastener prongs 54, 56**, as bent over and located within the sleeves of the holder, may be withdrawn because the prongs are sufficiently pliable.

As shown in FIG. 4, movement of the crank arm 42 swings blade 28 downwardly away from the support to thereby separate folder 58 with fastener 62 from the clamped bulk file material 48. Tabs 51 to each side of the tongue 28 prevent the fastener base sliding down the tongue underside as the tongue is swung downwardly. The old folder 58 may then be discarbed or kept for further processing.

In view of the fastener remover 28 having sufficient mechanical advantage to withdraw the fastener even when its prongs are clipped in a holder examplifies the aspect of the fastener being of the type which is releasable. It is understood, of course, that other forms of fasteners may be removed from the bulk sheet material as associated with the folder by adapting the apparatus to that particular type of fastener removal. It is also understood that, in instances where the fastener prongs are unclipped and project upwardly, the file material is still in essence fastened to the folder. This is by virtue of the upright prongs holding the material stationary relative to file cover as the material lies on the support.

The clamped bulk file material 48 is held in position by the clamp drive until a replacement folder with fastener is placed on the clamped material. Assuming that the new folder carries the same type of fastener 62, the tongue 28 may be swung downwardly out of the way to permit threading of the new fastener prongs through the apertures 64 which have been maintained in alignment in the bulk sheet material. This allows the ready replacement of the file folder and fastener before the clamp pad 30 is raised to release the material 48. In view of the U-shaped configuration for the pad 30, an optional consideration is that sufficient space can be provided to permit positioning of the holder over the prongs and clipping them in place to ensure all papers are secured to the folder before removal from the apparatus 10.

The process of this invention, therefore, includes the steps of inserting a support between file material 48 and folder 58 to position the support next the fastener, and in this embodiment, at each side of the fastener. The bulk material 48 is clamped in position and file folder with fastener is stripped away from the clamped material 48 by, in this instance, a pivotable tongue member 28. The replacement file folder with fastener is placed onto the clamped material by threading, in this instance, the fastener prongs through the alignment apertures 64 in the clamped material. The clamped material is released whereby file folder with material secured therein by fastener is ready for use.

The clamp drive for the clamp pad 30, which clamps the bulk form material 48 between the clamp pad and the support members 20, 22, may have various types of drive mechanisms. The simplest drive mechanism would be to form rod 34 with a helically threaded spindle portion which is rotatable relative to the pad 30 and engagable with a stationary threaded nut. Upon rotation of the spindle 34, movement between pad 30 and supports 20, 22 is accomplished to thereby clamp varying thicknesses of file material between the faces. Another embodiment for the clamp drive is to use an air cylinder for moving the clamp pad towards and away from the support. A valve may be provided to control the supply of pressurized air to the cylinder. The valve would preferably be of the foot peddle actuated type, so that the operator has both hands free to operate the apparatus in removing and replacing file folders.

Figure 8:
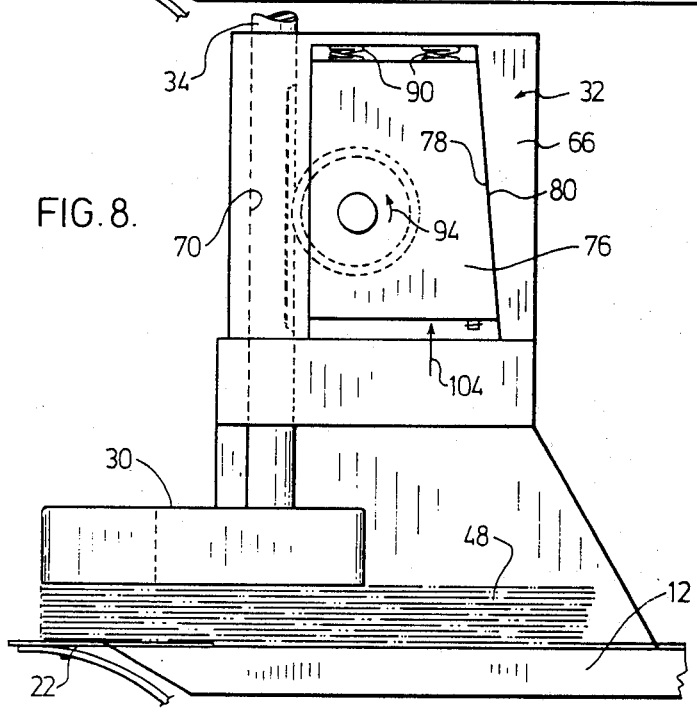
Figure 9:
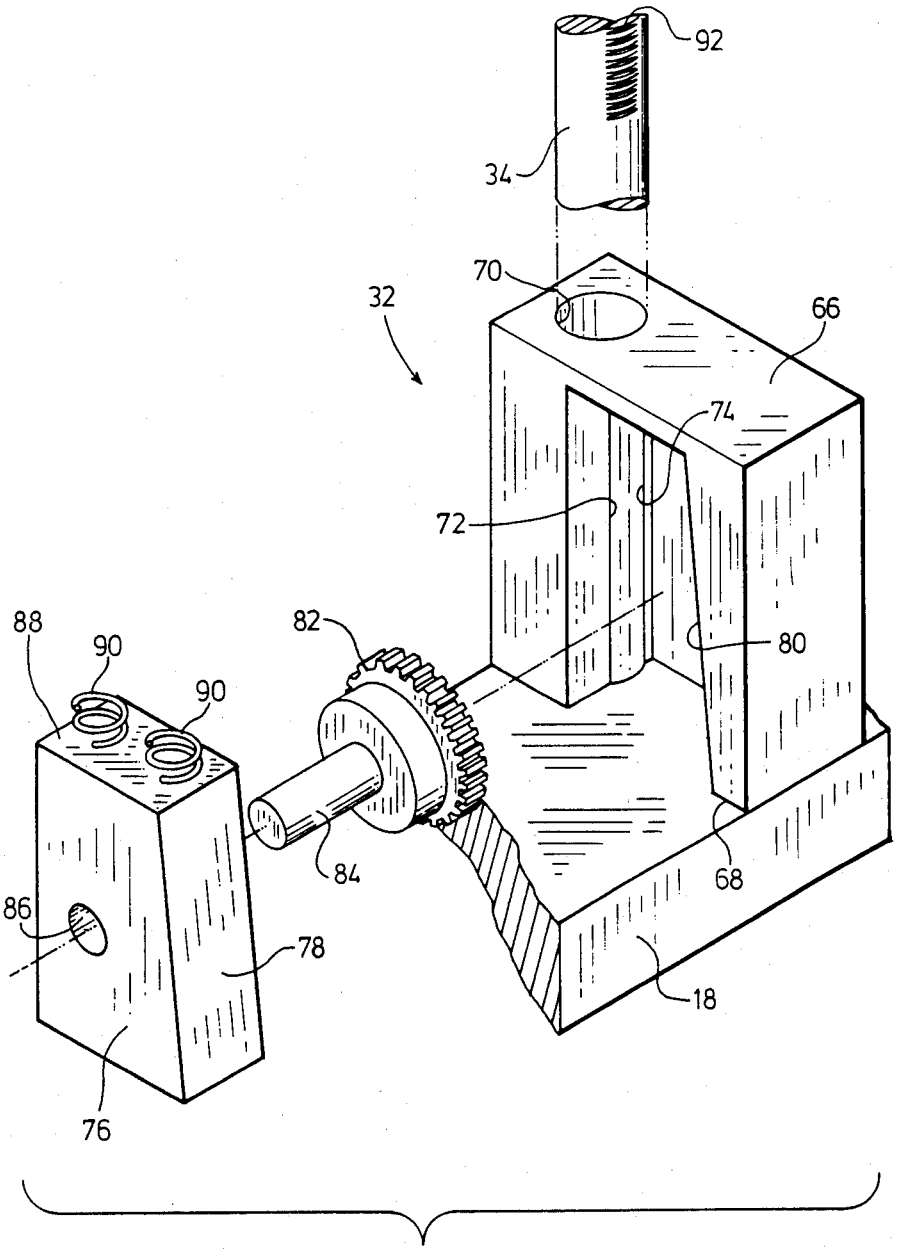
FIG. 9 is an exploded view in detail of a preferred drive arrangement for the apparatus clamp.

According to preferred embodiment of this apparatus, a clamp pad drive 32 is provided which can clamp thicknesses of material by a simple downward movement of the lever 36. The manner in which the drive mechanism operates is shown in sequence in FIGS. 6, 7 and 8. Referring to the detail of FIG. 9, the housing or block portion 66 of the clamp drive 32 is secured to the overhead member 18 at its base 68. The housing 66 includes a bore 70 extending along its length and opening into the housing along block edges 72 and 74. A wedging block 76, having a first sloped surface 78, is insertable into the housing 66. Sloped surface 80 of block 66 matingly engages the face 78 of wedging member 76. Mounted in wedging member 66 is a drive gear 82 which is journaled at 86 in block 76 on axle 84. Located on the upper surface 88 of the block 76 are compression springs 90 which resist or impede the upward movement of the block 76 into the housing 66. The rod 34, which is secured to the clamp pad in proper orientation has on its inner surface a gear portion 92 which is engagable with the teeth of drive gear 82 when the unit is assembled. Connected to axle 84, as it extends outwardly beyond the wedge 76, is the lever 36, the connection being shown in FIG. 2 at 94.

Figure 6:
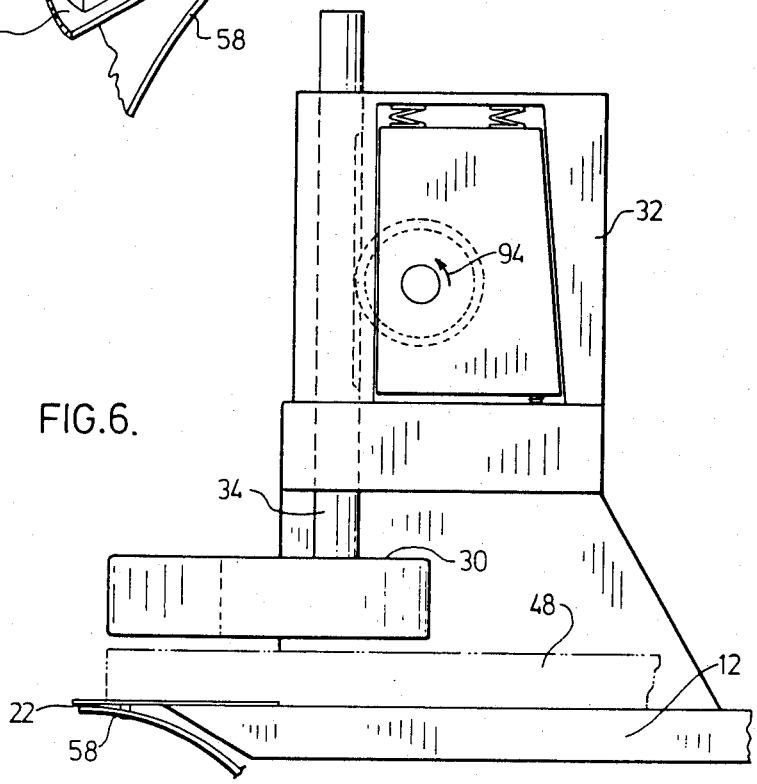
FIGS. 6, 7 and 8 demonstrate in sequence the clamping of fastened file material in position.
Figure 7:
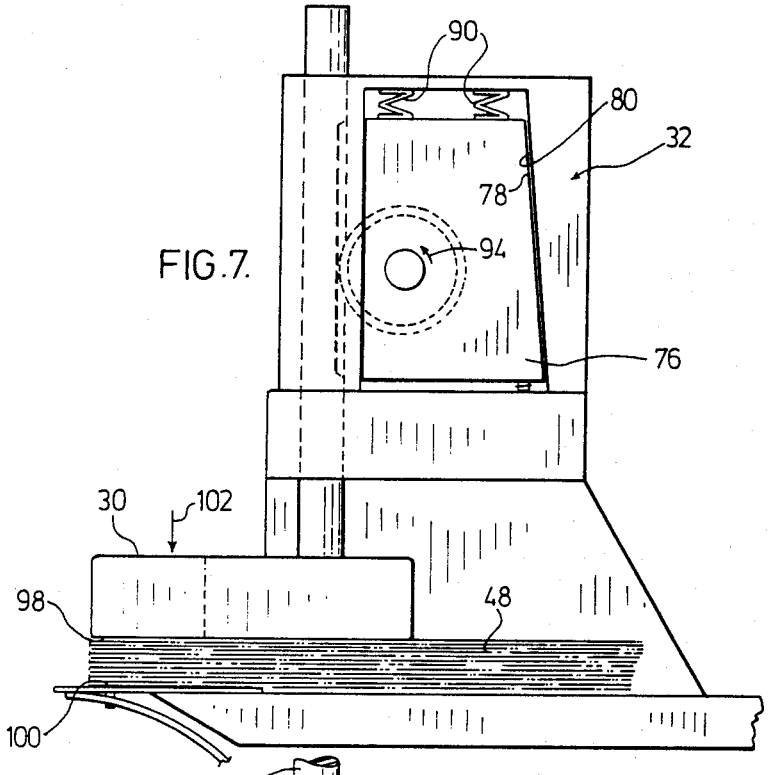

The operation of the clamp drive 32, as shown in FIG. 6, commences by moving crank arm 36 downwardly to cause rotation in the direction of arrow 94 to force the rod 34 downwardly. Thus, the clamp pad 30 moves towards the bulk file material 48 as it rests on support surface 22 with fastener base and file folder 58 located beneath the support plate. As shown in FIG. 7, continued rotation of the drive gear in the direction of arrow 94 causes the clamp pad 30 to contact the bulk material 48 and commence clamping it between its face 98 and the face 100 of the support means. As the downward forcing in the direction of arrow 102 of the clamp pad 30 encounters a resistance due to compressing of the bulk form material 48, a reaction in the wedging block 76 results to move it upwardly, in this instance, against the resistance of compression spring 90. As the wedging block 76 moves upwardly in direction of arrow 104, during continued rotation of the gear drive 82, the faces 78 and 80 meet in the manner shown in FIG. 8 and, as a result, commence forcing the wedging block 76 laterally of the housing 66. Since the drive gear 82 is journaled in the wedging block 76, the lateral movement in turn forces the rod 34 to bind against the inner face of the bore 70. There is thus a binding of the rod 34 along the entire height of the bore 70 and a binding of remaining moving parts. Continued rotation of the drive gear 82 in the direction of arrow 94 is eventually stopped by opposing force exerted by compression of the compression spring 90 in binding the moving parts of the drive.

The binding of rod 34 in the bore 70 and remaining moving parts holds the clamp pad 30 in clamping engagement to hold the file material in position during removal of the fastener and replacement of fastener with new file folder.

To release the clamping of the bulk material 48, the crank arm may simply be elevated to its original position because reverse rotation of the drive gear releases the binding action to permit retraction of the clamp pad 30.

In view of the operation of this clamp drive 32, it is apparent that it can accommodate varying thicknesses of material to, in each instance, securely clamp the material in position. The extent of the pressure exerted by clamping pad onto the material 48 is determined by the compression spring 90 where, as can be appreciated, the larger the resistance exerted by spring 90 in resisting compression, determines how much pressure has to be exerted on lever 36 before the sloped surfaces 78, 80 wedge, or force the wedging block 76 sufficiently laterally to provide the required binding of rod 34 in the bore 70. Thus, the drive system includes in this embodiment a compression spring to vary the extent to which clamping pressure is exerted on the file material during the replacement operation. A screw type adjustment may be provided to vary the preloaded condition of the compression spring. The screw type adjustment may, therefore, be used to vary the clamping force exerted on the file material during replacement.

As shown in FIG. 6, at the base of block 76 is an adjustable set screw 77 which spaces the base 79 of the block 76 from the upper surface 81 of support 18. The purpose of the adjustable set screw 77 is to reduce the distance the wedge 76 need travel upwardly to effect a binding and thus lock up of the moving drive parts. In turn, this reduces the extent to which the lever 36 is moved downwardly in clamping the file material against the support.

The apparatus is very convenient to operate. A simple downward movement of the lever 36 clamps the bulk form material 48 in position. A movement of the crank arm 42 strips away or withdraws the fastener with file folder to now ready the clamped material for receipt of new file folder with fastener.

In instances where the clamped material may include apertures of size smaller than the new fastener to be inserted, it may be necessary to provide a punch device on the apparatus 10 to rebore the holes, or provision may also be made to provide a threading of the fastener prongs 54, 56 through apertures 64 in the clamped material. Such device may be insertable through the clamped material to grasp the free ends of the prongs 54 and 56 and pull them upwardly through the holes in the clamped material. It is understood, however, that in most instances with properly sized holes, the new fastener need simply have its prongs 54, 56 inserted through the apertures to project upwardly beyond the clamped material ready for clipping in appropriate holder.

The apparatus and method of this invention, therefore, provides a system which is portable and which is capable in a simple manner to substantially facilitate file change-over. Thus, in instances when it is desired to convert large filing systems which may be upwards of 100,000 active files or more, this device may be used to substantially reduce the time in file conversion and to ensure that the material is not dropped or lost while being transferred from one file folder cover to another. The device also eliminates the risk of frustration of maintaining hole alignment during hand placement of sheets onto new file folder fastener.

Although various embodiments of the invention have been described herein in detail, it will be understood by those skilled in the art that variations may be made thereto without departing from the spirit of the invention of the scope of the appended claims.

We claim:

1. Apparatus for withdrawing a releasable fastener from and out of fastened bulk paper sheet comprising means for supporting fastened bulk paper sheet next its fastener during and after fastener withdrawal and means for withdrawing a releasable fastener away from and out of such supported side of bulk paper sheet.

2. Apparatus of claim 1, wherein said withdrawal means is adapted to exert a force against fastener base for withdrawing it from and out of supported paper sheet.

3. Apparatus of claim 1, wherein said support means includes means for maintaining bulk paper sheet position during and after fastener removal.

4. Apparatus of claim 1, wherein said support means includes means for clamping bulk paper sheet to maintain sheet position during and after fastener removal.

5. Apparatus of claims 1, 3, or 4 wherein said withdrawal means is adapted to withdraw a two prong fastener having an interconnecting elongate base portion, said withdrawal means having a tongue portion for insertion between fastened bulk paper sheet and base portion of a two prong fastener, said withdrawal means moving said tongue portion away from such supported side of bulk paper sheet to withdraw fastener prongs from and out of such bulk paper sheet.

6. A portable device for removing file cover secured by a fastener to fastened file material, comprising a support for supporting fastened file material next its fastener and apart from its cover and a file cover remover for placement between file cover and supported side of file material to overli fastener base and for removing such file cover away from said support and its fastener out of such supported file material.

7. A device of claim 6, wherein said support is a plate member positionable between fastened file material and its cover to support file material next its fastener.

8. A device of claim 6, wherein said support presents a free end which allows slipping said support next to fastener and between fastened file material and file cover.

9. A device of claim 8 adapted to remove file cover secured to fastened file material by a two prong fastener having an elongate interconnecting base portion, said support free end having a recessed portion of a width adapted to receive a two prong fastener and thereby support fastened file material at each side of a two prong fastener.

10. A device of claim 9, wherein said file cover remover has a tongue portion lying in the recessed portion of said support free end and insertable between file cover and supported side of fastened file material and means for forcing said tongue portion away from said support to remove file cover with fastener from fastened file material.

11. A device of claim 10, wherein said tongue portion is mounted on an axle pivoted about an axis remote said support free end, crank means secured to said axle which is manually graspable to swing said tongue away from said support.

12. A device of claim 10, wherein said tongue portion extends beyond the free end of said support, said tongue having a tapered forward end and adapted for insertion between a two prong fastener, said tongue tapered end guiding its movement between prongs of a two prong fastener.

13. A device of claims 6, 8 or 10, wherein clamp means is associated with said support to clamp supported file material and hold it during and after removal of file cover.

14. A machine for replacing a file folder having material fastened thereto by a fastener, comprising means for insertion between folder and fastened material to support fastened material next a fastener, means for holding fastened material in position and means for separating file folder with fastener away from supported held material, said means for holding such material being releasable after replacement of another file folder with fastener.

15. A machine of claim 14, wherein said support means supports material to each side of a fastener to permit said separation means to withdraw such fastener from held material through plane of and away from said support means.

16. A machine of claim 15, wherein said support means is a plate having a forward edge with a recess to permit slipping plate between fastened material and cover with said plate at each side of material fastener.

17. A machine of claim 14, wherein said separating means is adapted to remove file folder with prong fastener having interconnecting base, said separating means slipping between fastened material and file folder and overlying two prong fastener base, said separating means moving under force away from said support for separating file folder with fastener away from supported held material.

18. A machine of claim 17, wherein said support means is a plate having a forward edge with a recess to permit slipping plate between fastened material and cover with said plate at each side of a two prong material fastener having interconnecting base, said separating means comprising a tongue member lying in said plate recess and insertable between a two prong material fastener as it overlies two prong fastener base.

19. A machine of claim 18, wherein said tongue member has a tapered forward portion to guide its insertion between two prong fastener.

20. A machine of claim 14, wherein said separator means comprises a blade for insertion between file cover and material fastened thereto by a two prong fastener with interconnecting base, said blade overlying fastener base and being adapted to be moved away from said support means to separate file folder with fastener from supported held fastened material.

21. A machine of claim 20, wherein said blade is mounted on an axle to which a crank arm is fixed, movement of said crank arm in one direction swinging said blade away from said support means.

22. A machine of claim 20, wherein said support means comprises plate portions secured to support fastened material at each side of a two prong fastener, the spacing between each plate portion and a side of said blade being sufficient to receive a prong of a fastener.

23. A machine of claim 22, wherein said blade extends outwardly beyond said plate means.

24. A machine of claim 20, wherein said means for holding comprises an adjustable clamp pad movable to clamp fastened material between clamp pad and said support means.

25. A machine of claim 24, wherein said clamp pad is movable into and out of clamping position by connection to a releasable manually actuable clamp pad drive.

26. A machine of claim 14, wherein said means for holding comprises an adjustable clamp pad movable to clamp fastened material between clamp pad and said support means.

27. A machine of claim 26, wherein a drive moves said clamp pad into, holds it at and moves it out of file material clamping position, said drive being mounted on a housing secured to machine frame spaced apart from said support means, said drive comprising a drive gear mounted to a wedging block movable into said housing, a rod connected to said clamp pad and extending into a bore in said housing, said rod having a gear portion engaged with said drive gear, said wedging block moving into said housing as said drive gear is forcing said rod toward said support means commences clamping fastened file material, said wedging block movement forcing said drive gear to bind said rod against bore wall to maintain file material in clamped position during file cover replacement, subsequent reversal of drive gear releasing clamped file material.

28. A machine of claim 27, wherein means is provided to resist movement of wedging block into said housing to determine the extent of clamping pressure exerted on file material before binding of said rod.

29. A machine of claim 28, wherein said resistance means is a compression spring located between wedging block and housing to resist thereby movement of wedging block into housing.

30. A machine of claims 27, 28 or 29, wherein said wedging block has a sloped surface which engages a corresponding sloped surface in said housing, the orientation of said sloped surfaces being such to move said wedge with drive gear toward said rod and thereby bind said rod against bore wall.

31. A process for replacing a file folder comprising inserting a support between file material and file folder fastened thereto by a fastener to position said support next said fastener, clamping said fastened file material against said support, stripping file folder with fastener away from said supported clamped material, placing replacement file folder with fastener onto clamped material, releasing said clamped material and closing said fastener to secure said file material in said file folder.

32. A process of claim 31 for replacing a file folder with two prong fastener comprising inserting support at each side of said two prong fastener, and inserting a blade between file material and file folder to overlie fastener base and moving said blade away from said support to strip file folder from said clamped file material.

33. A process of claims 31 or 32, wherein said support is inclined at approximately 75° to facilitate said insertion of support between file material and file folder.

* * * * *